US007788826B2

(12) United States Patent
Frederick

(10) Patent No.: US 7,788,826 B2
(45) Date of Patent: Sep. 7, 2010

(54) DYNAMICALLY MODERATED SHOCK ATTENUATION SYSTEM FOR FOOTWEAR

(75) Inventor: Edward Frederick, Brentwood, NH (US)

(73) Assignee: Pierre Senizgues, Newport Beach, CA (US)

( * ) Notice: Subject to any disclaimer, the term of this patent is extended or adjusted under 35 U.S.C. 154(b) by 878 days.

(21) Appl. No.: 11/673,777

(22) Filed: Feb. 12, 2007

(65) Prior Publication Data

US 2008/0189983 A1 Aug. 14, 2008

(51) Int. Cl.
*A43B 13/12* (2006.01)

(52) U.S. Cl. ..... 36/28; 36/30 R; 36/44; 36/88

(58) Field of Classification Search ..... 36/88, 36/93, 28, 25 R, 30 R, 44
See application file for complete search history.

(56) References Cited

U.S. PATENT DOCUMENTS 4,183,156 A 1/1980 Rudy
4,229,546 A * 10/1980 Swan, Jr. ..... 36/117.6
4,255,202 A * 3/1981 Swan, Jr. ..... 106/122
4,486,964 A 12/1984 Rudy
4,506,460 A 3/1985 Rudy
5,367,792 A * 11/1994 Richard et al. ..... 36/114
5,667,895 A * 9/1997 Jenkner ..... 428/424.4
5,711,029 A * 1/1998 Visco et al. ..... 2/24
5,741,568 A 4/1998 Rudy
5,854,143 A 12/1998 Schuster et al.
5,869,164 A * 2/1999 Nickerson et al. ..... 428/76
5,947,918 A * 9/1999 Jones et al. ..... 602/58
5,958,546 A * 9/1999 Mardix et al. ..... 428/71
6,127,010 A * 10/2000 Rudy ..... 428/35.7
6,158,149 A * 12/2000 Rudy ..... 36/29
6,701,529 B1 3/2004 Rhoades et al.
6,835,763 B2 * 12/2004 Ellis et al. ..... 523/218
6,913,802 B1 7/2005 Plant
6,944,974 B2 * 9/2005 Falone et al. ..... 36/44
7,020,988 B1 4/2006 Holden et al.
7,490,416 B2 * 2/2009 Townsend ..... 36/28
2002/0144433 A1 * 10/2002 Dennis et al. ..... 36/44
2004/0031169 A1 * 2/2004 Jensen et al. ..... 36/27
2005/0160626 A1 * 7/2005 Townsend ..... 36/30 R
2006/0026864 A1 * 2/2006 Arbeiter ..... 36/29
2009/0094855 A1 * 4/2009 Finkelstein ..... 36/28

OTHER PUBLICATIONS

Graham, Budden, Defense and Comfort: New Advancement in Impact-Protection Textiles; , T3 Technical Textile Technology, Apr. 2006, U.S.
Dow Corning, Active Protection System Information.

* cited by examiner

*Primary Examiner*—Marie Patterson
(74) *Attorney, Agent, or Firm*—Stetina Brunda Garred & Brucker

(57) ABSTRACT

Various embodiments of this invention disclose a dynamically responsive shock attenuation system for footwear that comprises two or more materials with different, narrowly prescribed physical properties, which, when used together, produce a dynamic, continuous, and proportional response over a wide range of impact forces. In various embodiments of the invention, the two materials comprise a first material that exhibits generally Newtonian behavior to impact forces and a second material that exhibits generally non-Newtonian behavior to impact forces.

19 Claims, 2 Drawing Sheets

DYNAMICALLY MODERATED SHOCK ATTENUATION SYSTEM FOR FOOTWEAR

FIELD OF INVENTION

This invention relates, generally, to footwear; more particularly, to shock attenuating cushioning systems for use in footwear.

BACKGROUND

Cushioning systems used in athletic footwear are designed to be capable of attenuating a wide range of impact force magnitudes. Ordinary impact forces in walking and running, for example, vary between approximately 600 Newtons (N) and 2500 N. However, values as high as 15,000 N have been measured as a consequence of certain extreme maneuvers, for example, in the sport of skateboarding. (See: "Impact Forces During Skateboarding Landings," *J. Determan*, et al., Proceedings, Thirteenth Biennial Conference, Canadian Society for Biomechanics, Halifax, Aug. 4-7, 2004, page 28). Because the magnitudes of these forces are dependent on body mass, for convenience, impact force data is often normalized to body weight ((body mass)×(acceleration due to gravity)) and described as multiples of body weight. In this manner, these impact forces can be described as varying between approximately 1 Body Weight (BW) and up to and exceeding some 20 BW, in extreme cases.

Because of the wide range of impact forces that athletes experience while practicing their sport, particularly forces involved in high-impact or extreme sports such as skateboarding, no single conventional shock absorption system will satisfy all of athletes' needs. Ordinary impact forces, which may range from 1 BW to 5 BW, such as those experienced in walking, running, and other non-extreme sports, are also encountered in extreme sports, such as skateboarding. The majority of impact forces that skateboarders encounter, for example, are in the range from approximately 1 BW to 5 BW. However, oftentimes during a typical day of skateboarding, extreme impacts on the order of 6 BW to more than 15 BW may be generated in attempting and performing maneuvers that involve large vertical displacements.

Shock attenuating systems that address moderate, ordinary impacts are generally not suitable for extreme impacts due to limitations on physical properties of common shock attenuating systems. For example, one common shortcoming is that these systems reach their displacement limit or "bottom out."

One common type of material used in athletic shoe shock attenuating systems, polymeric foams, receive their shock attenuating properties principally from the many small gas bubbles trapped in the foam's polymeric matrix. They operate similarly to an inflated shock attenuating system that works by trapping air in a bladder. When a typical polymeric foam, or similar air inflated shock attenuating system, is exposed to high impact forces, the gases within are compressed and reach their displacement limit, thus, becoming non-compliant and ceasing to provide further shock attenuation. The same problem exists for other shock absorbing systems that are more structural in nature, such as springs or molded plastic structures.

Some designs have sought to improve upon the above shortcomings by utilizing a structure that is stiffened or enlarged, or, in the case of foams or inflated systems, the gas volumes and pressures in certain materials have been raised to a high enough level to be able to accommodate higher impact forces. At ordinary levels of impact, however, the resulting systems may often be too thick or too stiff and uncomfortable.

Thus, generally speaking, conventional shock-attenuating systems suffer from being useful over only a narrow range of impact forces and tend to have undesirable physical properties when impacted outside that narrow range. Thus, these systems are undesirable for extreme sports, such as skateboarding, where shock attenuation is needed for a very broad range of impact forces.

Shock attenuating systems may be generally described in terms of point-elastic and area-elastic systems. A point-elastic shock attenuating system deforms non-uniformly (see FIG. 1). That is, for example, the greatest compliance is found under the area of highest pressure and the amount of deformation of the shock-attenuating layer varies in proportion to the distribution of forces over its surface. Standing on an inflated air mattress is an example of point-elastic behavior; the area just beneath the foot where pressures are high shows the greatest deformation while other areas show little or no deformation. Meanwhile, an area-elastic system distributes forces over a wider area causing a much greater area of the shock attenuating structure that is engaged in shock attenuating (see FIG. 2). A stiff sheet of plywood laid over an inflated air mattress is an example of an area-elastic system, because the forces applied by standing on the plywood are distributed over a much larger portion of area of the air mattress.

In order to improve upon these conventional shock-attenuating systems, several systems have been developed using combinations of shock absorbing materials in order to provide shock absorption over a broader range of impact forces. U.S. Pat. No. 4,506,460 to Rudy, for example, discloses the use of a stiff moderator to distribute the forces of impact over a larger area of the shock attenuating system. The use of such moderators, however, further restricts the range of impact shocks that can be accommodated because the stiff moderator is limited in its shock absorbing abilities. While successfully distributing forces over a wider area, the stiff moderator fails to adequately absorb high impact forces. Another approach to providing shock attenuation is disclosed by U.S. Pat. No. 4,183,156 to Rudy. Rudy's patent discloses an air cushion for shoe soles that uses a semi-rigid moderator in order to distribute the loads over the air cushion. While moderating the cushioning forces, this system suffers from some of the same shortcomings as that of the area-elastic systems discussed above. Also, the patent fails to disclose a method for providing dynamic moderation of the forces.

Another such spring moderator is disclosed by U.S. Pat. No. 4,486,964 also to Rudy. The '964 patent discloses the use of a moderator having a high modulus of elasticity over a cushioning material. The '964 patent, however, fails to disclose the use of a non-Newtonian material as an improved, dynamic moderator. A cushioning system that utilizes a stiff layer of material sandwiched between two foam, midsole layers is disclosed by U.S. Pat. No. 4,854,057 to Misevich et al. Misevich's patent, however, fails to disclose a cushioning system that uses the advantageous features of both Newtonian and non-Newtonian materials.

Another such system is disclosed by U.S. Pat. No. 5,741,568 also to Rudy. Rudy's '568 patent discloses the use of a fluid filled bladder surrounded by an envelope, in order to combine the properties of compressible padding materials with the effects of fluid materials.

The use of non-Newtonian materials, particularly dilatant materials, has also been used in shock attenuating systems, in order to provide a broader range of impact force attenuation. A non-Newtonian material is a material, often a fluid or gel or gel-like solid, in which the stiffness of the material changes with the applied strain rate. Newtonian materials, meanwhile, are said to behave linearly in response to strain rate so their stiffness is constant over a wide range of strain rates.

Most materials used in shock attenuating systems are somewhat viscoelastic and are not perfectly Newtonian, but the degree to which they are sensitive to the rate of loading is negligible when compared with materials with distinctly non-Newtonian properties.

"Newtonian materials" as we define them for the purposes of this invention, are compliant shock attenuating materials with predominately linear load displacement characteristics. Such Newtonian materials may demonstrate some non-linear properties in imitation of non-Newtonian properties, but they are essentially linear in their load displacement behavior. Furthermore, any distinctly non-Newtonian behavior of these materials can be explained by bottoming out, or, by extreme physical deformation of the material, and not by the fundamental physical and chemical properties that create the character of truly "non-Newtonian materials."

Materials that qualify for use as Newtonian in an effective cushioning system must be compliant enough to attenuate peak impact forces. Compliance in this context is the strain of an elastic body expressed as a function of the force producing that strain. Compliant shock attenuating systems in footwear are used to decelerate the mass that is producing peak impact forces. These compliant materials yield to the force of impact, but resist with proportional stiffness to decelerate the impacting mass in a controlled manner, thus reducing peak forces, and delaying the time to peak impact. Therefore, an effective Newtonian material must be relatively linear in its load displacement properties, but also compliant enough and thick enough to significantly attenuate peak impact forces. A non-compliant material would not be able to attenuate peak forces, and a material that was compliant, but too thin, would bottom out and be inadequate as a shock attenuating material.

Non-Newtonian properties, meanwhile, are commonly described as either dilatant or pseudo-plastic. Dilatant materials demonstrate significant increases in stiffness as loading rate increases. Pseudo-plastic materials, on the other hand, show the opposite response to increased rates of loading, i.e., their stiffness decreases as loading increases.

U.S. Pat. Nos. 6,701,529, to Rhoades et al. and 5,854,143, to Shuster et al., disclose the use of dilatant materials to moderate the impact forces of a fall or of a ballistic collision. Neither of these patents, however, discloses the use of dilatant materials in combination with a layer of shock absorbing material for attenuating shocks over a broad range of impact forces. What is more, at higher rates of loading and higher force magnitudes, these dilatant materials by themselves would be relatively stiff and non-compliant. Thus, the use of these materials would be undesirable in applications where attenuation of high impact forces is required. Using a dilatant material by itself means that higher impact loads induce an instantaneous increase in stiffness that make the material less shock attenuating. Accordingly, the dilatant material when used by themselves, may be less useful as a shock attenuating material. At the very instant that they need to provide the greatest amount of compliance and shock attenuation, they are less compliant and less shock attenuating.

The device shown and described in U.S. Pat. No. 6,913,802 appears to disclose a dilatant material that is used by itself to attenuate shocks. Foam appears to be attached to the dilatant material but does not appear to serve the purpose of shock attenuation. In support thereof, Col. 4, Lines 5-8 of the '802 application describes the foam as increasing comfort for the wearer.

Another approach to using a combination of materials for shock attenuation is disclosed by U.S. Pat. No. 7,020,988 to Holden et al. Holden's invention discloses a shock attenuating system wherein a system used to attenuate the lower range of impacts is used in combination with a non-compressible second system that is engaged and allowed to provide shock attenuation for the higher range of impacts. Thus, this system allows for both extreme and ordinary impacts to be attenuated. This combined system, however, remains limited by the narrow physical properties of the two individual systems that have been selected for use. Also, the response of the combined system is limited because the two-component system is somewhat discontinuous in its shock attenuating properties.

Thus, there remains a long felt need in the art for a shock attenuating system that is responsive to a broad range of impact force magnitudes, that provides attenuation fairly continuously over a wide range of forces, and that responds to these forces proportionally and adjusts automatically to the actual impact load that it is called upon to absorb.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION OF THE INVENTION

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention.

In the following description, certain terminology is used to describe certain features of one or more embodiments of the invention. For instance, "shoe" refers to any of the various coverings for the human foot, including shoes, boots, sandals, and similar such items known within the art; "sole" refers to the base of any shoe made of rubber, plastic, or other such materials known within the art; "midsole" refers to any midsole, insole, or other middle layer of the sole of a shoe.

One embodiment of the invention is directed towards improving upon the above shortcomings by disclosing a dynamically responsive shock attenuation system that automatically changes its mechanical properties in response to the level of force applied and the rate of loading of that impact force. One embodiment of the invention achieves these goals by utilizing a combination of two materials with different, narrowly prescribed physical properties that, when used together, produce a continuous and proportional response over a wide range of impact forces.

Figure 1:
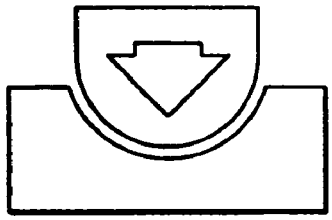
FIG. 1 (PRIOR ART)
FIG. 1 is an illustration of a prior art point elastic system.
Figure 2:
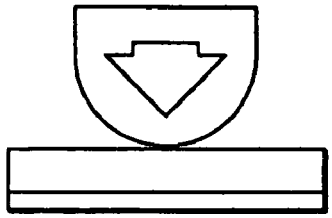
FIG. 2 (PRIOR ART)
FIG. 2 is an illustration of a prior art area elastic system.
Figure 3:
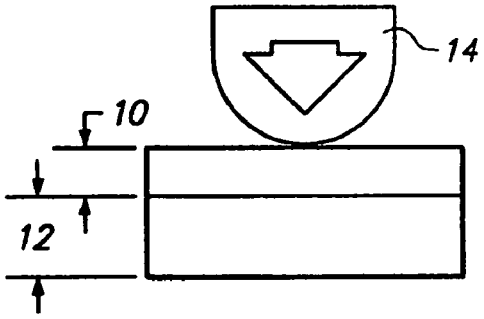
FIG. 3 is an illustration of a non-Newtonian material in combination with a Newtonian material.
Figure 4:
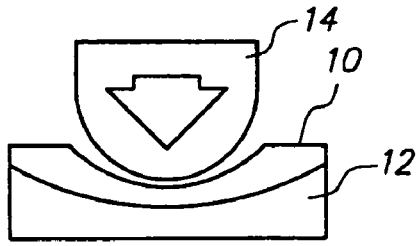
FIG. 4 is an illustration of the non-Newtonian material and Newtonian material in FIG. 3 with a light impact load.
Figure 5:
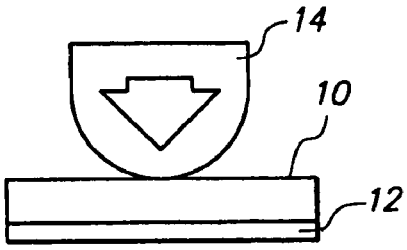
FIG. 5 is an illustration of the non-Newtonian material and Newtonian material in FIG. 3 with a high impact load.

In one embodiment of the invention, a proportional response is achieved by using a non-Newtonian material 10 in combination with a generally Newtonian material 12 (see FIG. 3) to produce a predictable varying moderating effect that causes the shock attenuating system to range between point-elastic and area-elastic in its physical properties, as shown in FIGS. 4 and 5.

Two of the advantages of using point-elastic shock attenuating systems in sports footwear are that these systems have a cradling and laterally stabilizing effect, as shown in FIG. 4. This effect is especially created at the parts of the foot under the heel and ball of the foot at which pressures are relatively high. Such systems are generally supportive, stable, and comfortable at the narrow range of impact forces from approximately 1 BW to 5 BW, commonly encountered in non-extreme sports.

With higher impact forces, commonly encountered in extreme sports such as skateboarding, however, the relatively narrow column of shock attenuating material underlying the higher-pressure areas will reach its displacement limit, bottom out, and will no longer provide adequate shock attenuation.

The use of a moderator, similar to the stiff sheet of plywood mentioned in the example above, distributes the impact forces over the whole area of the shock attenuating material, which underlies the moderator. This creates an area-elastic system that is able to absorb higher impact forces because it can engage a much larger area and distribute the force over this larger area.

Nonetheless, the introduction of a stiff moderator, such as that disclosed by Rudy's '460 patent, above, introduces other undesirable limitations. For example, area-elastic systems are not as comfortable for the foot or as anatomically conformable as point-elastic systems, and area-elastic systems may be biomechanically unstable. More importantly for sports applications that require a wide range of impact attenuation, area-elastic systems have a limited range of effectiveness as shock attenuating systems. Thus, while an area-elastic system is capable of absorbing relatively higher impact forces, it may be considered too stiff and ineffective to absorb lower magnitude impact forces and, therefore, may be too uncomfortable for the wearer.

One embodiment of this invention improves upon these shortcomings by using non-Newtonian materials 10. By way of example and not limitation, by combining this dynamically responsive NNM 10 with a layer of compliant shock attenuating materials 12, a shock attenuation system is created that behaves in a point-elastic manner under low level impacts 14 (see FIG. 4) and in an area-elastic manner under high level impacts 14 (see FIG. 5).

Meanwhile, at intermediate impact levels, the system will mix point-elastic and area-elastic properties in proportion to the load and rate of loading, such that a relatively continuous shock attenuation range is created. That is, the system will adapt automatically to vary its shock attenuation properties in response to the level of impact forces 14. Thus, at intermediate levels, the invention allows for a gradual transition between point-elastic and area-elastic properties.

The cushioning layer 12 used in combination with the NNM 10 generally behaves in a Newtonian or linear manner in response to impact forces in order to best take advantage of the effects of the dynamically adjusting NNM layer.

In another embodiment of the invention, a shear thickening or dilatant material may be utilized within the moderator 10 to increase stiffness in proportion to the load, in order to create a progressively increasing shock attenuation system progressively increasing in stiffness. In yet another embodiment of the invention, a thixotropic material may be used in the moderator to produce a progressively decreased stiffness in response to high loads. Thixotropic materials generally exhibit time-dependent change in resistance such that the longer the materials undergoes shear, the lower their resistance.

Figure 6:
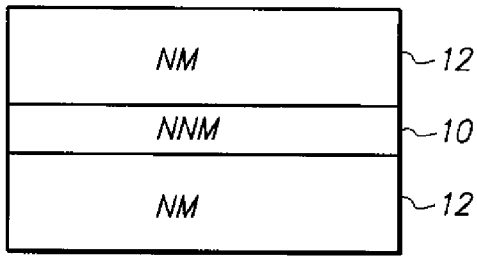
FIG. 6 is one embodiment of various moderators used in combination or tandem with one another to produce effects specific to the forces encountered on various parts of the foot under pressure.
Figure 7:
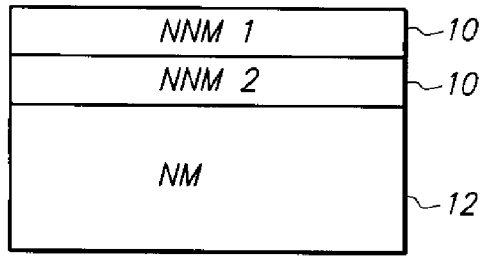
FIG. 7 is an alternative embodiment to the embodiment shown in FIG. 6.

These various moderators may be used in combination or tandem with one another to produce effects specific to the forces encountered on various parts of the foot under pressure (e.g., see FIGS. 6 and 7). In one embodiment of the invention, for example, dilatant materials are used for the heel of the foot while thixotropic materials are used for the forefoot.

One class of dilatant materials that may be used to produce the NNM is polyborosiloxanes. Other materials that are useful in the construction of the NNM and remain within the contemplation of this invention include, but are not limited to: rheopectic materials, thixotropic materials, pseudo-plastics, Bingham plastic materials, anelastic materials, yield pseudo-plastic, yield dilatant materials, and Kelvin materials. These and other materials may be adapted to the NNM to create biomechanically defined shock attenuation properties.

Some materials known in the art for constructing the Newtonian cushioning layer and that remain within the contemplation of the invention include, without limitation: inflated or gas-filled bladders, slabs of Ethylene Vinyl Acetate foam, Polyurethane and other conventional foam materials, gel or gel-like materials, structural plastic point-elastic cushioning systems, and other materials, known within the art, which provide a compliant shock attenuating layer that can function as an area-elastic or a point-elastic shock attenuating system when appropriately moderated by the NNM.

In one embodiment of the invention, the NNM is encapsulated or otherwise contained such that its lateral expansion is limited, as shown in FIG. 7. An encapsulating material 16, generally speaking, should have a high degree of elasticity and resilience such that it does not interfere with or mask the physical properties of the non-Newtonian material 10. Some encapsulating materials that are known within the art and are within the contemplation of the invention include, without limitation: encapsulating film envelopes, sheets of plastic film or plastic film envelopes, polyurethane film envelopes, polymer based envelopes, woven fabric envelopes, and other such materials known within the art.

Figure 8:
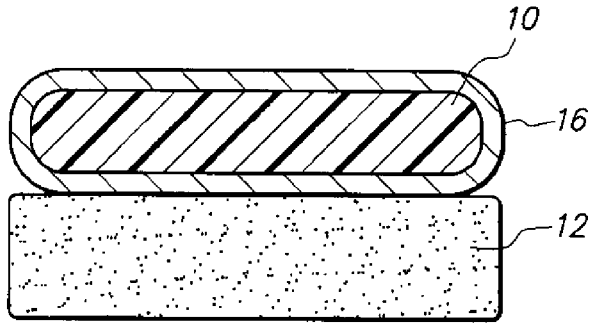
FIG. 8 is an illustration of an encapsulated non-Newtonian material which is used in combination with a Newtonian material.
Figure 9:
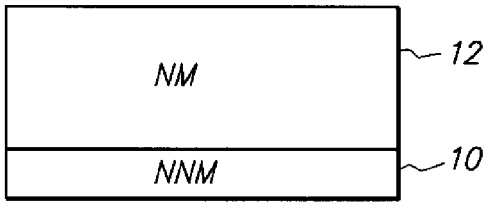
FIG. 9 is an illustration of a Newtonian material disposed above a non-Newtonian material.
Figure 10:
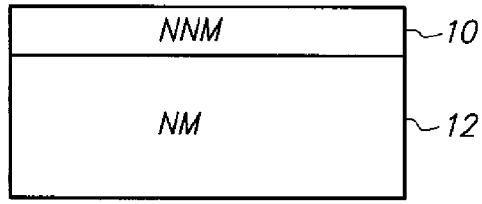
FIG. 10 is an illustration of a non-Newtonian material disposed over a Newtonian material.

It should be noted that the various embodiments of the invention are claimed without any specific claim to an orientation or configuration because the principles of the invention may be practiced in a number of orientations and configurations. For example, a Newtonian material 12 may be placed over a non-Newtonian material 10 (see FIG. 8), or visa-versa (see FIG. 9). Also, a non-Newtonian section may be included over a portion of a Newtonian shoe insole. These and other variations are known within the art and these various orientations and configurations remain within the contemplation of the invention.

It should further be noted that the principals of the invention may be practiced with any of the various shock attenuating mechanisms for footwear known in the art. The principals of the invention may, for example, be practiced with shoe insoles, midsoles, removable shoe insoles, shoe soles, and other such shock attenuating mechanisms for footwear known in the art.

In an aspect of the invention, a shock attenuation system for footwear is provided. The system may comprise a multi-layered system comprising a first layer and a second layer. The first layer may comprise a moderating material that generally exhibits non-Newtonian behavior in response to impact force. The second layer may compromise a cushioning material that generally exhibits Newtonian behavior is response to the impact force. The shock attenuation system may comprise one or more of the shock attenuation systems taken from the group: shoe insoles; shoes midsoles; and removable shoe insoles. Also, the shock attenuation system for footwear may comprise a plurality of shock attenuation units. The shock attenuation units may each be composed of said multi-layered system comprising a first layer and a second layer. The number of said first layers comprising moderating materials that generally exhibit non-Newtonian behavior in response to impact forces and the number of said second layers comprising cushioning materials that generally exhibit Newtonian behavior is response to impact forces may be related by a 1:1 ratio.

Figure 11:
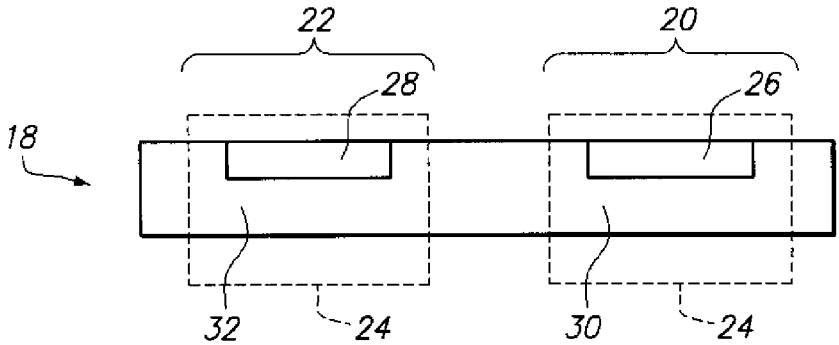
FIG. 11 is a cross sectional view of a footwear illustrating heel and forefoot regions with a multi-layered system.

Referring now to FIG. 11, a shock attenuation system for an article of footwear 18 is disclosed. The system may comprise heel and forefoot cushioning regions 20, 22. The heel cushioning region 20 and the forefoot cushioning region 22 may each have a multi-layered system 24 with a first layer 26, 28 disposed above a second layer 30, 32. The first layer 26 of the heel region 20 may comprise a first moderating material (e.g., dilatant material) that generally exhibits non-Newtonian behavior in response to an impact force. The second layer 30 of the heel region 20 may comprise a first cushioning material that generally exhibits Newtonian behavior in response to the impact force. The first layer 28 of the forefoot cushioning 22 region may comprise a second moderating material (e.g., thixotropic material) that generally exhibits non-Newtonian behavior in response to an impact force. The second layer 32 of the forefoot region 22 may comprise a second cushioning material that generally exhibits Newtonian behavior in response to the impact force.

In summary, one embodiment of the invention comprises a shock attenuating system that is a combination of a compliant, Newtonian material, and a non-Newtonian moderator, that combine to produce a system that is responsive to a broad range of impact force magnitudes, provides attenuation fairly continuously over the range of forces, and responds to these forces proportionally to the actual impact load that it is absorbing.

What is claimed is:

1. An article of footwear having a shock attenuation system, the shock attenuation system comprising:

a multi-layered system comprising a first layer and a second layer;

said first layer comprising a moderating material that generally exhibits non-Newtonian behavior in response to impact force; and said second layer comprising a cushioning material that generally exhibits Newtonian behavior in response to impact force.

2. An article of footwear according to claim 1, wherein said moderating material is selected from the group consisting of: plastic materials, Bingham plastic materials, yield pseudo-plastic materials, yield dilatant materials, polyborosiloxanes, "shear thinning" materials, "shear thickening" materials, Maxwell materials, Oldroyd-B materials, Kelvin materials, Anelastic materials, Rheopectic materials, thixotropic materials and combinations thereof.

3. An article of footwear according to claim 1, wherein said cushioning material is selected from the group consisting of: gas filled bladders, Ethylene-Vinyl Acetate, Polyurethane, foam materials, gel or gel-like materials, structural point-elastic cushioning systems, polymer based cushioning materials and combinations thereof.

4. An article of footwear according to claim 1, wherein said shock attenuation system for footwear comprises one of the shock attenuation systems selected from the group consisting of: shoe insoles; shoe midsoles; and removable shoe insoles.

5. An article of footwear according to claim 1, wherein said shock attenuation system for footwear comprises a plurality of shock attenuation units, said shock attenuation units each composed of said multi-layered system comprising a first layer and a second layer.

6. An article of footwear according to claim 5, wherein the number of said first layers comprising moderating materials that generally exhibit non-Newtonian behavior in response to impact forces and the number of said second layers comprising cushioning materials that generally exhibit Newtonian behavior in response to impact forces are related by a ratio of one-to-one.

7. An article of footwear according to claim 1, wherein the first layer is disposed above the second layer.

8. An article of footwear having a shock attenuation system, the footwear defining an inside width, the shock attenuation system comprising:

a multi-layered system comprising a first layer and a second layer;

said first layer comprising a moderating material that generally exhibits non-Newtonian behavior in response to an impact force the moderating material extending wider than a foot width of the wearer;

said second layer comprising a cushioning material that generally exhibits Newtonian behavior in response to the impact force; and an encapsulating envelope surrounding said first layer, said encapsulating envelope limiting expansion of said moderating material in response to the impact force.

9. An article of footwear according to claim 8, wherein said encapsulating envelope is selected from a group consisting of: encapsulating film envelopes, plastic film envelopes, polyurethane film envelopes, polymer-based envelopes, woven fabric envelopes and combinations thereof.

10. An article of footwear according to claim 8, wherein the encapsulating envelope limits lateral expansion of the moderating material in response to the impact force.

11. A shock attenuation system for an article of footwear, comprising:

first cushioning region;

said first cushioning region comprising a first layer disposed above a second layer;

said first layer of said first cushioning region comprising a thixotropic moderating material that generally exhibits non-Newtonian behavior in response to an impact force;

said second layer of said first cushioning region comprising a cushioning material that generally exhibits Newtonian behavior in response to the impact force.

12. A shock attenuation system for an article of footwear according to claim 11, wherein said first region comprises the area of the footwear beneath the forefoot.

13. A shock attenuation system for an article of footwear according to claim 12 further comprising a second cushioning region comprising a multi-layered system with a first layer disposed above a second layer, said first layer of said second cushioning region comprising a second moderating material that generally exhibits non-Newtonian behavior in response to impact force, said second layer of said second cushioning region comprising a second cushioning material that generally exhibits Newtonian behavior in response to the impact force, wherein said second moderating material comprises a dilatant material.

14. A shock attenuation system for an article of footwear according to claim 13, further comprising an encapsulating envelope surrounding at least one of said first layer of said first region and said first layer of said second region.

15. A shock attenuation system for an article of footwear according to claim 13, wherein said first and second moderating materials are selected from a group consisting of: plastic materials, Bingham plastic materials, yield pseudo-plastic materials, yield dilatant materials, polyborosiloxanes, "shear thinning" materials, "shear thickening" materials, Maxwell materials, Oldroyd-B materials, Kelvin materials, Anelastic materials, Rheopectic materials, thixotropic materials and combinations thereof.

16. A shock attenuation system for an article of footwear according to claim 13, wherein said first and second cushioning materials are selected from the group consisting of: gas filled bladders, Ethylene-Vinyl Acetate, Polyurethane, foam materials, gel or gel-like materials, structural point-elastic cushioning systems, and polymer based cushioning materials.

17. A shock attenuation system for an article of footwear according to claim 11, further comprising an encapsulating envelope surrounding said thixotropic moderating material, said encapsulating envelope limiting the expansion of said thixotropic moderating material in response to applied impact force and wherein said encapsulating envelope is selected from a group consisting of: encapsulating film envelopes, plastic film envelopes, polyurethane film envelopes, polymer-based envelopes, fabric envelopes and combinations thereof.

18. A shock attenuation system for an article of footwear according to claim 13, wherein the first layers of the first and second cushioning regions are disposed over the second layers of the first and second cushioning regions.

19. A shock attenuating system for an article of footwear according to claim 11, wherein the second moderating material is a shear thickening material.

* * * * *